United States Patent [19]

Rohner et al.

[11] Patent Number: 4,535,945

[45] Date of Patent: Aug. 20, 1985

[54] METHOD AND DEVICE FOR LOCATING AND HOLDING A THREAD END

[75] Inventors: Joachim Rohner, Monchen-Gladbach; Heinz Kamp, Wegberg, both of Fed. Rep. of Germany

[73] Assignee: W. Schlafhorst & Co., Monchen-Gladbach, Fed. Rep. of Germany

[21] Appl. No.: 511,778

[22] Filed: Jul. 7, 1983

[30] Foreign Application Priority Data

Jul. 7, 1982 [DE] Fed. Rep. of Germany ..... 3225379

[51] Int. Cl.[3] ..... B65H 54/22

[52] U.S. Cl. ..... 242/35.6 R

[58] Field of Search ..... 242/35.6 R, 35.5 R, 242/35.6 E, 36

[56] References Cited

U.S. PATENT DOCUMENTS

| | | | |
|---|---|---|---|
| 3,033,478 | 5/1962 | Furst | 242/35.6 R |
| 3,061,216 | 10/1962 | Furst et al. | 242/35.6 R |
| 3,077,311 | 2/1963 | Furst | 242/35.5 R |
| 3,078,054 | 2/1963 | Furst | 242/35.5 R |
| 3,203,634 | 8/1965 | Furst | 242/35.6 R |

*Primary Examiner*—Stanley N. Gilreath

*Attorney, Agent, or Firm*—Herbert L. Lerner; Laurence A. Greenberg

[57] ABSTRACT

A method for locating and holding an end of a thread wound on a spool at a winding station, with a thread connector having a thread suction nozzle with a thread sensor connected thereto, for partially unwinding the thread, includes starting the thread connector with the winding station, simultaneously bringing the spool at the winding station to a standstill after rotation in a forward direction and bringing the thread suction nozzle of the thread connector from a starting position to a position close to the surface of the spool, subsequently supplying the thread suction nozzle with suction for a limited time as soon as the rotation of the spool has ceased for sucking-in the thread end, rotating the spool in a reverse direction during the suction step after the rotation of the spool has ceased, subsequently holding the sucked-in thread end with the suction nozzle, and subsequently moving the thread suction nozzle back to the starting position thereby inserting the thread into the thread connector if the sensor has sensed the presence of the thread in the thread suction nozzle, while bringing the spool to a standstill again, and supplying the thread suction nozzle with suction again before moving the thread suction nozzle to the starting position if the thread is not sensed by the sensor, and a device for carrying out the method.

13 Claims, 2 Drawing Figures

METHOD AND DEVICE FOR LOCATING AND HOLDING A THREAD END

Figure 1:
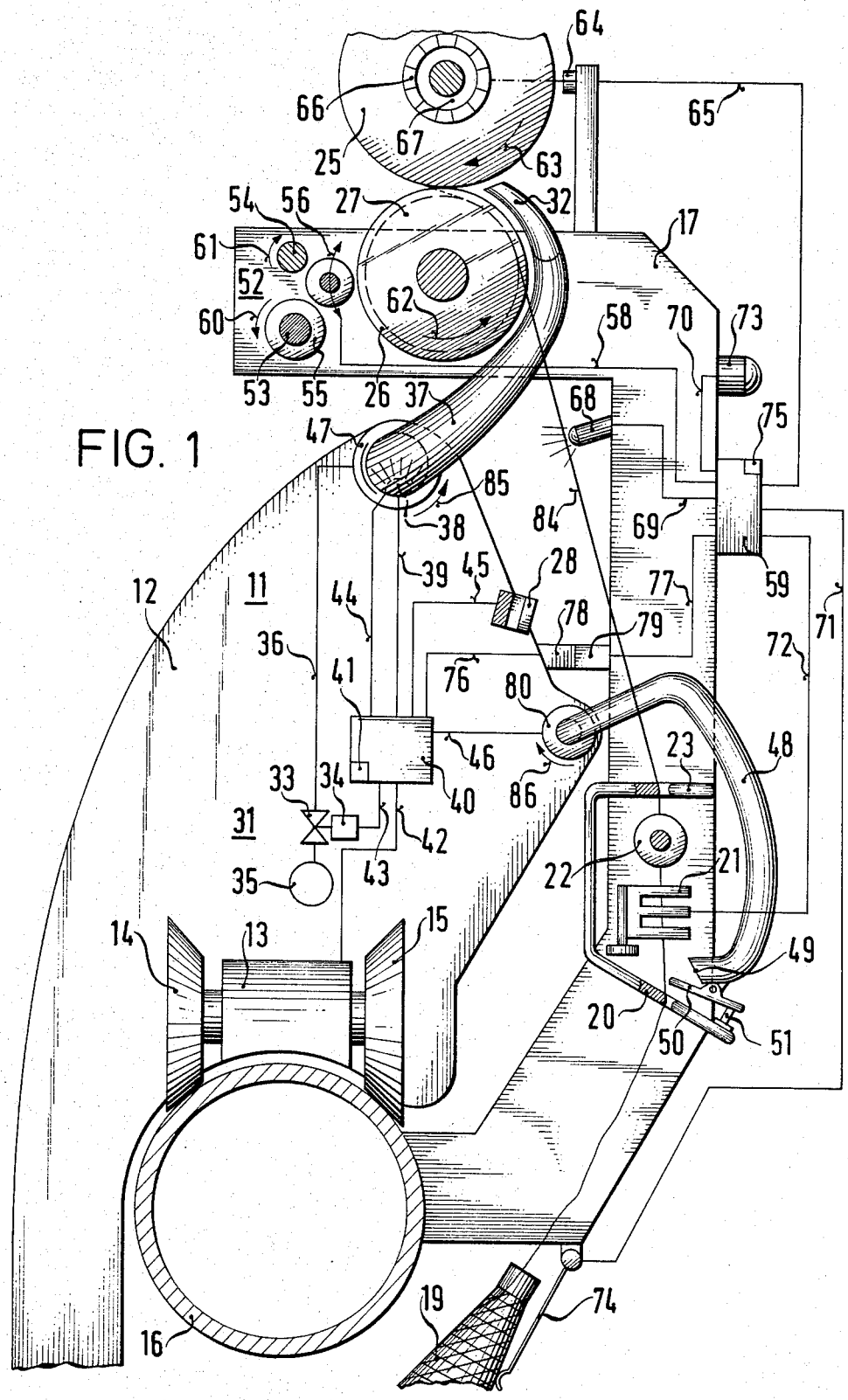

The invention relates to a method and device for locating and holding an end of a thread which is wound on a spool at a winding station, with the aid of a thread connector for the purpose of partially unwinding the thread. The method and device may relate to a winding station of a winding machine, the spooling station of a spinning machine, or any other work station where a thread, or several threads, are wound. For example, the thread connector may be a knotting device, a splicing device, or some other thread connecting apparatus. The thread connector can be a structural unit integral with the winding station, or it can be separate from the winding station. For example, the thread connector may be a movable device capable of travelling and it may be disposed in such a way as to service several winding stations, if required.

For example, if the winding station is capable of winding large and small spools, and is provided for winding different coil formats, the duration of the individual work operations during the manufacture of a thread connection depends on the size and the format of the most bulky spool. Necessarily, the thread connecting operation and its preparatory steps for smaller and less bulky spools take more time than absolutely necessary.

It is accordingly an object of the invention to provide a method and device for locating and holding a thread end, which overcomes the hereinafore-mentioned disadvantages of the heretofore-known methods and devices of this general type, to accelerate the operations required for partially unwinding a thread wound on a spool to a minimum duration, to shorten the idle time of the spooling station and to therefore accelerate the coil winding process.

With the foregoing and other objects in view there is provided, in accordance with the invention, a method for locating and holding an end of a thread wound on a spool at a winding station, with the aid of a thread connector having a thread suction nozzle with a thread sensor connected thereto, for the purpose of partially unwinding the thread, which comprises starting the thread connector with the winding station, simultaneously bringing the spool at the winding station to a standstill after rotation in a forward direction and bringing up the thread suction nozzle of the thread connector from a starting position to a position close to the surface of the spool, subsequently supplying the thread suction nozzle with suction air for a limited time as soon as the rotation of the spool has ceased for sucking-in the thread end, rotating the spool in a reverse direction during the suction step after the rotation of the spool has ceased, subsequently holding the sucked-in thread end with the suction nozzle, and subsequently moving or guiding the thread suction nozzle back to the starting position thereby inserting the thread into the thread connector if the sensor has sensed the presence of the thread in the thread suction nozzle, while bringing the spool to a standstill again, and supplying the thread suction nozzle with suction again before moving the thread suction nozzle to the starting position if the thread is not sensed by the sensor.

In accordance with another mode of the invention, there is provided a method which comprises indicating the presence of the thread end in the thread suction nozzle with a thread sensor, and subsequently ending the thread suction step and delivering the thread to the thread connector during the suction cycle during the step of moving the thread suction nozzle back to the starting position.

In accordance with a further mode of the invention, there is provided a method which comprises rotating the spool again before supplying the thread suction nozzle with suction again if the thread has not been sucked into the thread suction nozzle.

In accordance with an added mode of the invention, there is provided a method which comprises, during the steps of rotating the spool again and supplying suction again: rotating the spool for a limited time in the forward direction, subsequently bringing the spool to a standstill, subsequently supplying the suction nozzle a second time with suction air for a limited time while the spool is rotated again in the reverse direction, subsequently moving the suction nozzle back to the starting position independent of the presence of the thread end in the suction nozzle, i.e. with or without the thread, initiating the delivery of the thread to the thread connector if thread has been sucked into the thread suction nozzle, and issuing an inhibit signal if the thread has not been sucked into the thread suction nozzle.

In accordance with an additional mode of the invention, there is provided a method which comprises performing all further thread supply operations up to the beginning of a thread joining process, without additional delay.

In order to carry out the method, there is provided a device for locating and holding an end of a thread, comprising a winding station including a spool on which the thread is wound, and a driving device connectible to the spool for switching the spool into forward, reverse and standstill operation; a thread connector for partially unwinding the thread, including a thread joining or connection device, a thread suction nozzle movable up close to or into vicinity of the surface of the spool for sucking-in the thread and movable to the thread joining device for inserting the sucked-in thread into the tread joining device, a switchable air suction supply device connected to the tread suction nozzle for applying suction to the thread through the thread suction nozzle, and an air suction metering device, and a sensor connected to the thread suction nozzle for sensing presence of the thread of the suction supply device; at least one control element; and switchable operative connections connected between the control element and the winding station and between the control element and the thread connector, the control element causing suction to be reapplied to the thread through the thread suction nozzle before moving the thread suction nozzle to the thread joining device if the thread is not sensed by the sensor.

In accordance with another feature of the invention, there are provided means for chronologically or sequentially: starting the thread connector with the winding station, moving the thread suction nozzle to vicinity of the spool for sucking-in the thread, simultaneously switching the driving device to the standstill operation, switching on the suction supply device in dependence on the driving device being switched into the standstill operation, switching the driving device into the reverse operation, moving the suction nozzle to a starting position thereby inserting the sucked-in and held-back thread into the thread joining device if necessary, switching the driving device to the standstill operation, activating the thread joining device, and subsequently switching on the winding station again.

In accordance with a further feature of the invention, there is provided a sensor connected to the thread suction nozzle and responsive to the sucked-in thread end, the sensor being connected to the control element for ending suction with the suction nozzle.

In accordance with an added feature of the invention, the control element includes a repeater for repeating suction with the suction nozzle before the suction nozzle is moved to the thread joining device.

In accordance with an additional feature of the invention, there are provided means for activating the repeater only if sucking in the thread with the suction nozzle was not successful.

In accordance with again another feature of the invention, there is provided a device connected to the control element for measuring rotation and/or standstill of the spool.

In accordance with again a further feature of the invention, the measuring device is connected to the driving device or spool.

In accordance with a concomitant feature of the invention, there is provided a thread sensor connected to the control element for activating the measuring device by indicating absense of the thread delivered to the spool in vicinity of the winding station.

The command for partially unwinding the thread may originate from the winding station, as is normally the case in automatic winding machines, for example. However, the command may also be given manually. After the command has been given, the thread connector is started by the winding station, and at the same time the spool at the winding station is stopped, if it has not already stopped. After the thread connector has been started, a thread-suction nozzle is immediately moved near the surface of the spool. This is done while the spool is still decelerating. After the spool has stopped, or even when the stopping can be foreseen, the thread suction nozzle is supplied with suction air for a limited time. The supply of air to the suction nozzle may already be started while the spool still rotates, but will stop when the negative pressure at the suction nozzle becomes effective. Immediately after the spool has stopped, but still during the suction cycle, the spool is rotated in the reverse direction. This serves to loosen the thread end on the spool, so that it can be located and sucked-in.

The limitation of the suction time can be effected by a timer element, for example. Another possibility for limiting the time will be mentioned below. If the aspiration operation is successful, the sucked-in thread end is held by the thread suction nozzle. In the most simple case, this is effected by the continued action of the suction air. However, a special holding device may be provided at the suction nozzle.

For example, the thread suction nozzle can move in a circular path to the vicinity of the spool surface. In any case, the path of the thread suction nozzle must be chosen in such a way that the thread is inserted into a thread joining device of the thread connector, while the thread suction nozzle is moved back to its starting position. Meanwhile, the spool is stopped again, because the thread joining device functions better if the spool does not move.

The thread suction process may be successful, but it may also fail. In the most simple case, there is no direct information as to whether the thread was sucked-in or not. In this case, the thread connecting device will operate, but no thread connection is produced. Only after the whole unsuccessful thread connecting operation is concluded, can a new suction cycle or thread connection cycle be started again. An explanation will be given below as to how the invention can save time in this respect.

If the winding station is intended to produce spools with very different thread materials, the suction time provided must be set to suit the least advantageous thread material. Since this results in a loss of time for the threads which can be located more easily, according to a further feature of the invention, the presence of the thread end in the thread suction nozzle is indicated by a thread sensor, after which the thread suction cycle is ended and delivery of the thread to the thread connection device is initiated.

To avoid a situation in which the thread joining device operates empty in the case of an unsuccessful thread suction cycle, a second suction cycle can be performed immediately after an unsuccessful first suction cycle. It is advantageously during the second suction cycle to rotate the spool forward for a limited time and then to stop it again, after which the thread suction nozzle is supplied with suction air for a limited second time, while the spool is again rotated in reverse. Unless still another suction cycle is required, because even the second suction attempt was not successful, the thread suction nozzle is subsequently moved back to its starting position again, independently of whether it picked up a thread or not. In the case of a successful suction of the thread, the transfer of the thread to the thread joining device is initiated. If the suction process was not successful, an inhibiting signal is produced. In general, the inhibiting signal appears at the winding station. However, the inhibiting signal also has the effect of preventing the thread connector at the inhibited winding station from operating. If the thread connector services several winding stations, it bypasses the respective winding station every time. In this case the disturbance must be removed by the operating personnel.

The invention deals only with locating and holding the end of a thread which is wound on a spool in a winding station. The length of this thread is to be increased. Thus, a second thread is required for this purpose, which originates, for example, from a spinning machine, lies in a storage container, or is wound on a storage coil. The preparation of this thread and the conduction thereof to the thread connector, is part of the additional operations for the thread supply, which are to be performed according to the invention in such a way that no waiting time occurs. These operational steps must also be performed before the beginning of the thread connecting operation. They occur parallel to the work operations to which the invention directly relates.

Other features which are considered as characteristic for the invention are set forth in the appended claims.

Although the invention is illustrated and described herein as embodied in a method and device for locating and holding a thread end, it is nevertheless not intended to be limited to the details shown, since various modifications and structural changes may be made therein without departing from the spirit of the invention and within the scope and range of equivalents of the claims.

Figure 2:
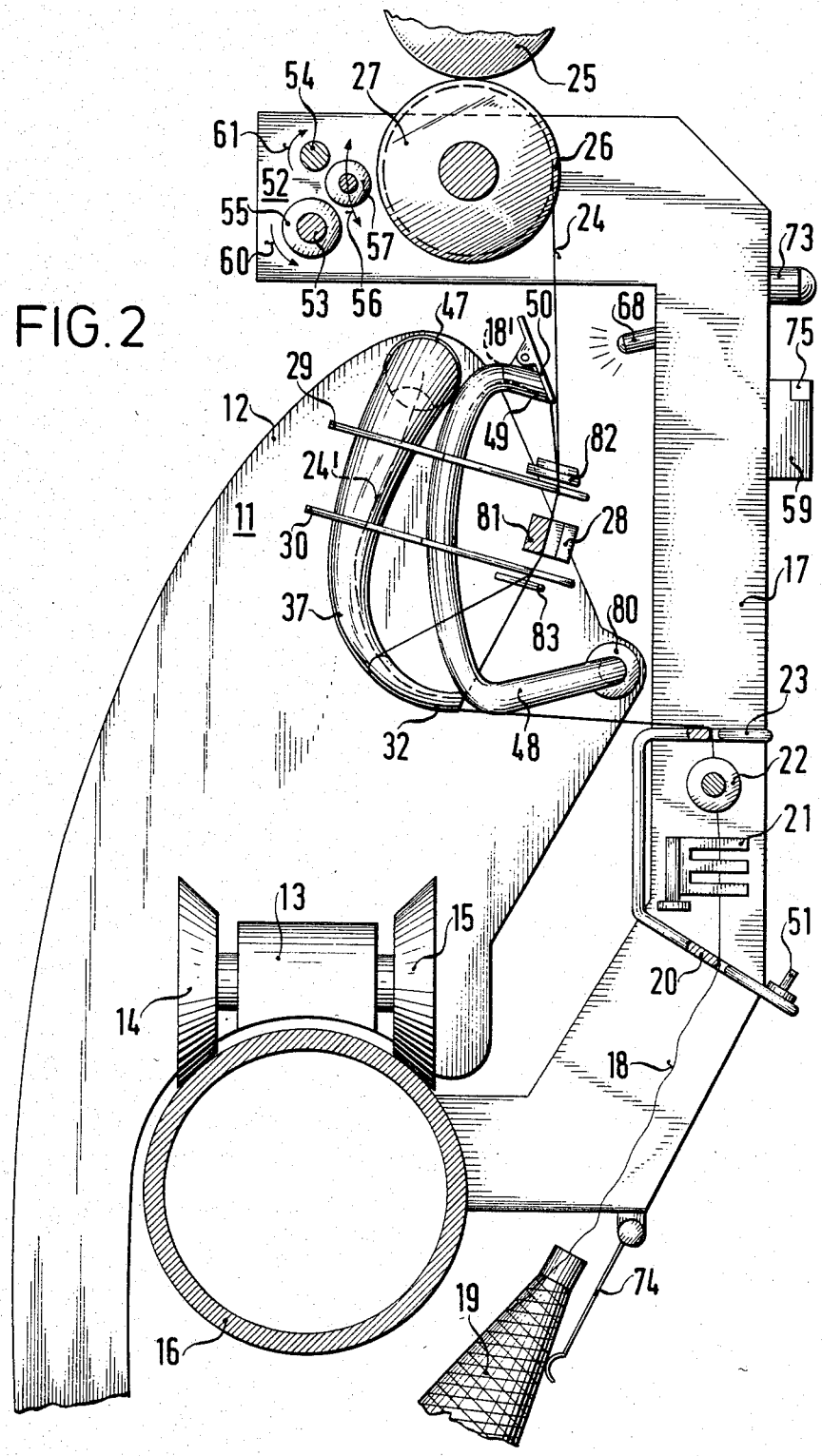

The construction and method of operation of the invention, however, together with additional objects and advantages thereof will be best understood from the following description of specific embodiments when read in connection with the accompanying drawings, in which:

FIGS. 1 and 2 are similar fragmentary, diagrammatic, elevational views of the device according to the invention shown in two different working positions.

Referring now to FIGS. 1 and 2 of the drawing in detail, there is seen a thread connector 11 which includes a machine frame 12 with a travelling drive 13. The travelling drive 13 is provided with travelling rollers 14 and 15, with which the thread connector 11 can travel on a support tube 16. The support tube 16 is disposed along a winding machine (spool-machine), only one stationary winding station 17 of which is shown. The thread connector 11 is just operating at this winding station 17.

A lower thread 18 is conducted from a run-off spool 19, through a thread guide 20, a thread sensing element or feeler 21, a thread brake 22, and another thread guide 23, to the thread connector 11, as shown in FIG. 2.

An upper thread 24 is pulled from a spool 25, and is also conducted to the thread connector 11 over a thread guiding drum 27 which is provided with helical grooves 26. The elements 18 to 27 belong to the winding station 17. Further details of the winding station 17 will be described below.

The thread connector 11 is provided with two plates 29, 30, which are fastened to the machine frame 12. A thread connecting or joining device 28 is disposed between the plates 29, 30. Additionally, the thread connector 11 includes a suction nozzle 32 for the thread, which is connected to a controllable air suction admission device 31, and can be moved close to the surface of spool 25. The air suction device 31 is provided with a control valve 33 having a suction air metering or dosing device 34. The air suction valve 33 is connected at the input side thereof with a suction air source 35, and is connected at the output side thereof through a line 36 to a swing arm 37 of the thread suction nozzle 32, which has a hollow inside.

The thread suction or aspiration nozzle 32 is shaped in such a way, and its swing path is chosen in such a way, that it simultaneously acts as a device for inserting the sucked-in thread 24 into the thread connection device 28. A sensor 38 which responds to the sucked-in thread end is disposed in the ibnterior of the hollow swing arm 37 of the thread suction nozzle 32. The sensor 38 is connected by a line 39 with a control element 40, for the purpose of ending the suction operation. For this reason, the control element 40 also contains a repeater device 41 for the thread suction operation. Operative connections 42 to 46 are provided from the control element 40 to the travelling drive 13, the suction air metering device 34, a pivot or swing mechanism 47 for the swing arm 37, the thread connection device 28, and a pivot or swing mechanism 80 for the swing arm 48 of a second thread suction nozzle 49, which also has a hollow interior. The second thread suction nozzle 49 serves for sucking in and holding the lower thread 18. For this purpose, it is provided with a spring-loaded lid 50, which hits a stop 51 and opens for the purpose of sucking in the thread. The stop 51 is fastened to the thread guide 20 of the winding station 17.

Besides the already mentioned elements, the winding station 17 is provided with a driving device 52 for the spool 25, which can be set for forward, reverse and stop. The driving device 52 includes a shaft 53 which passes through the length of the winding machine for forward motion and another shaft 54 which passes through for reverse motion. The shaft 53 is provided with a friction wheel 55 at the winding station 17. Furthermore, the driving device 52 contains a coupling wheel 57 which can slide in the direction of an arrow 56, and which has an operative connection 58 to an additional control element 59. In this case, however, the control element 59 is located at the winding station 17.

The shaft 53 rotates continuously in the direction of the arrow 60 and the shaft 54 rotates in the opposite direction as shown by an arrow 61. If the coupling wheel 57 is moved downward, it contacts the friction wheel 55, and lies against the tread guiding drum 27, thereby rotating the thread guiding drum in the direction of the arrow 62. In this case, the spool 25 rolls on the thread guiding drum 27 in the direction of the arrow 63.

If the coupling wheel 57 is moved upward, it lies against the shaft 54 and again against the thread guiding drum 27. The thread guiding drum is therefore rotated against the direction of the arrow 62 and the spool 25 rotates against the direction of the arrow 63. In the origin or rest position, the coupling wheel 57 is not in connection with other rotatable parts.

The spool 25 is provided with a device 64 which measures the rotation and optionally the standstill position of the spool. The device 64 includes an operative connection 65 to the control device 59. The device 64 is in the form of a light reflection gate or barrier which works in conjunction with color contrasting strips 66 that are disposed on the periphery of a rotatable spool mounting element 67.

The device 64 for measuring the rotation and/or the standstill of the spool 25 can be activated by a thread sensor 68, which senses the fact that a thread conducted to the spool 25 in the region of the winding station 17, is missing.

There are additional operative connections 69, 70, 71 and 72 from the control element 59 to the thread sensor 68, a malfunction signal 73, a spool run-off feeler 74 and the thread feeler or sensor 21.

The control element 59 also contains a starting device 75 for the winding station 17. Furthermore, operative connections are provided between the two control elements 40 and 59, i.e. between the thread connector 11 and the winding station 17, by means of a cable 76 which is connected to the control element 40 and ends at a multi-contact switch 78 and a cable 77 connected to the control element 59 and also ending in a multi-contact switch 79. The multi-contact switches are closed and the operative connections are effected only when the thread connector 11 is in its operating position in front of the winding station 17, as shown in FIG. 1.

Various details of the winding station 17 and of the thread connector 11 are also shown in FIG. 1. Some details relating to the thread connection device 28 are only shown in FIG. 2. This applies for the above-mentioned plates 29 and 30, a bar or traverse 81 for supporting the thread connection device 28, and thread cutting devices 82 and 83 for cutting the thread ends after the thread connection is made. FIG. 2 shows that the two plates 29 and 30 are only connected with the machine frame 12 at the left back end portions thereof. In this way, the two swing arms 37 and 48 can move behind these plates without interference.

In FIG. 1, the undisturbed thread path is designated with reference numeral 84. As long as there is no broken thread at the winding station 17, and at the adjacent winding stations which are serviced by the thread connector 11, the thread connector travels back and forth on the carrier tube 16 behind the winding stations, while the two swing arms 37 and 48 are in their basic position as shown in FIG. 2. Every time the thread connector 11 passes a winding station, such as the winding station 17, the multi-contact switches 78 and 79 come in contact with each other. However, there is no communication between the two control elements 40 and 59.

If a thread-break does occur, for example, the electro-optical thread monitor or sensor 68 senses that the previously undisturbed thread path 84 is disturbed. The thread end of the upper thread 24 immediately runs onto the spool 25. The thread end of the lower thread 18 normally is suspended in the thread brake 22. The thread break signal travels from the thread monitor 68 through the operative connection 69 to the control element 59. When the thread connector 11 passes by at the disturbed or inoperative winding station, a communication takes place between the two control devices 59 and 40 through the multi-contact switches 78, 79. The travelling drive 13 is now stopped, and the thread connector is positioned behind the winding station 17. The multi-contact switches provide a continuous connection between the two control elements 40 and 59. Now the thread connector is activated throughout the winding station 17. Subsequently, the two control elements initiate several working steps which serve the purpose of picking up the two thread ends again, and of connecting them with each other.

First, the spool 25 in the winding station 17 is stopped. In order to accomplish this action, the control element 59 causes the coupling wheel 57 of the drive 52 to be moved to the position shown in FIG. 1 through the operative connection 58. By virtue of this action, the thread guiding drum 27 loses contact with the friction wheel 55. The thread guiding drum 27 rotates freely until it comes to a stop. This also causes the spool 25 which rolls on the drum to stop. The duration of the free rotation may be shortened by a braking device.

After the thread connector 11 has been activated, the control element 40 causes a swinging motion of the swing arm 37 from the position shown in FIG. 2 to the position shown in FIG. 1, through the operative connection 44. In this way, the thread suction nozzle 32 is moved close to the surface of the spool 25. Simultaneously, the control element 40 causes the swing arm 48 to move from the position shown in FIG. 2 to the position shown on FIG. 1, through the operative connection 46. The lid 50 therefore contacts the stop 51, and thus opens the thread suction nozzle 49. The swing arm 37 moves in the direction of an arrow 85, while the swing arm 58 moves in the direction of an arrow 86.

When the spool 25 comes to a standstill, this occurence is reported through the operative connection 65 to the control element 59. Through the operative connection 58, the control element 59 causes the coupling wheel 57 to be moved upward in the direction of the arrow 56. The coupling wheel 57 therefore forms a frictional connection between the shaft 54 and the thread guiding drum 27. The thread guiding drum 27 thus operates in reverse and rotates against the direction of the arrow 62. Accordingly, the spool 25 also rotates in reverse against the direction of the arrow 63.

When the spool 25 has stopped, the control element 40 activates the air suction metering device 34 through the operative connection 43, so that the thread suction nozzle 32 is supplied with suction air for a limited time. The suction time may be limited by a preset time setting, or it may be limited by the fact that the sensor 38 recognizes the presence of the sucked-in thread end 24' and sends a signal through the line 39 to the control element 40, which then turns off the suction air metering device 34 again.

Meanwhile, the sucked-in thread end 24' is held by the thread suction nozzle. This holding action can also be effected with the aid of air suction. In practice, the thread suction nozzle 32 is returned to the starting position even before the end of the suction period, and the upper thread 24 is inserted into the thread connection device 28. FIG. 2 shows the thread position in this state. As seen along the length of the thread, the upper thread 24 lies in the grooves 26 in the thread guiding drum 27, adjacent the thread cutting device 82, in the thread connection device 28, in the open thread cutting device 83 and finally in the thread suction nozzle 32 as well.

While the upper thread 24 is fetched back from the spool 25 in the described manner, and its end 24' is placed into the swing arm 37, the lower thread 18 is also gripped at its thread end 18' by the suction nozzle 49 and is clamped by the lid 50. As the swing arm 37 is pivoted back to its starting position, the second swing arm 48 is also brought back to the starting position, as shown in FIG. 2. The lower thread 18 lies, as before, in the thread guide 20, in the thread sensing element 21 and in the thread brake 22. The thread end 18 then passes through thread guide 23 and over the back of the thread suction nozzle 32 passing the thread cutting device 83. The thread end 18 travels to the thread connection device 28 and from there it travels through the open thread cutting device 82 to the thread suction nozzle 49. The thread 18' is clamped in the nozzle 49 with the aid of the lid 50. In this way, it is assured that all operations required for feeding the thread from the thread supply spool 19 have been carried out before the actual thread joining operation is started.

At this time, the control element 59 has returned the driving device 52 to the freely rotating position again. The spool 25 is therefore brought to a stop, this is advantageously not later than the point in time at which the upper thread 24 has been inserted into the thread connection device 28.

After locating and holding the thread end 24' of the upper thread on the spool 25, and after locating and holding the thread end 18' of the lower thread 18, the actual thread joining operation can be performed, after being initiated by the control element 40 through the operative connection 45. Subsequently, a signal travels from the control element 40 through the cable 76, the multi-contact switches 78 and 79, and the cable 77 to the control element 59, which then operates the starting device 75. The starting device 75 can also be manually operated if so desired. After starting, the multi-contact connection is interrupted, and the winding station 17 is again set in operation. The thread connector 11 then receives a command to travel further on.

However, if the thread locating operation has not been successful, the swing arm 37 does not return to its starting position. Instead, the repeater device 41 is activated, and a second thread searching operation follows immediately after the first thread search. For the second thread locating operation, the spool 25 is brought from rest to a forward motion for a limited time interval, and then stopped again. The thread suction nozzle 32 is subsequently supplied with suction air for a limited duration for a second time. The spool 25 is then rotated again in reverse direction, and the thread suction nozzle 32 is subsequently returned to its starting position, with or without the thread. All this happens in the same pattern and manner as was described with respect to the first suction operation. If the second thread suction operation was successful, the transfer of the upper thread 24 to the thread connection device 28 is initiated. In the case of an unsuccessful thread suction operation, the control element 59 gives an inhibit or disturbance signal to the inhibit or disturbance signal device 73 through the operative connection 70.

The swing arm 48 can operate independently of the swing arm 37. The operation of the swing arm 48 is controlled by the control element 59, according to the output of the thread sensor or feeler 21 and the spool run-off feeler 74. The spool run-off feeler 74 sends information that a sufficiently large amount of thread is present on the run-off spool 19, if this is the case. If this is not the case, the spool run-off feeler 74 sends a signal through the operative connection 71 to the control element 59, which then causes the reverse motion of both swing arms 37 and 48 to their starting positions, discontinues the multi-contact connection, and sends an inhibit or disturbance signal to the signal inhibit or disturbance device 73. The thread connector 11 can now move further on, and, for example, a new feed spool must be inserted into the winding station 17.

The thread feeler 21 sends appropriated information if the lower thread 18 is still present between the thread guide 20 and the thread brake 22. If this is not the case, a signal is sent through the operative connection 72 to the control element 59, which then also causes the return motion of both swing arms 37 and 48 to their starting positions, and which causes an inhibit signal to travel through the operative connection 70 to the inhibit or disturbance signal device 73.

Only then, if the feed spool 19 still has a sufficient supply of thread, and the lower thread 18 is still present in vicinity of the thread feeler 21, can the thread end on the take up spool 25 be lengthened.

The thread connection device 28 can be constructed, for example, as a thread splicing device. After the thread connection has been made, the two thread cutting devices 82 and 83 are operated. These two thread cutting devices remove the two unnecessarily long thread end 18' and 24' from the thread splice. Thereafter, the thread connection device 28 sets the thread free again and the thread subsequently follows the thread path 84. The severed thread ends are moved by a following burst of suction air into the interior of the thread connector 11, and from there they enter a non-illustrated collection line.

The invention is not limited to the illustrated and described embodiment which was used as an example. The source 35 for the suction air can be located outside the thread connector 11. For example, the carrier tube 16 can be used as an air suction line. In this case, it is necessary to connect the thread connector to this line each time for suction air. It is also possible to provide each winding station 17 with its own thread connector 11. In this case, it would be possible to combine the two control elements 40 and 59 into a single element.

We claim:

1. Method for locating and holding an end of a thread wound on a spool at a winding station, with a thread connector having a thread suction nozzle with a thread sensor connected thereto, for partially unwinding the thread, which comprises starting the thread connector with the winding station, simultaneously bringing the spool at the winding station to a standstill after rotation in a forward direction and bringing the thread suction nozzle of the thread connector from a starting position to a position close to the surface of the spool, subsequently supplying the thread suction nozzle with suction for a limited time as soon as the rotation of the spool has ceased for sucking-in the thread end, rotating the spool in a reverse direction during the suction step after the rotation of the spool has ceased, subsequently holding the sucked-in thread end with the suction nozzle, subsequently moving the thread suction nozzle back to the starting position thereby inserting the thread into the thread connector if the sensor has sensed the presence of the thread in the thread suction nozzle, while bringing the spool to a standstill again, and supplying the thread suction nozzle with suction again before moving the thread suction nozzle to the starting position if the thread is not sensed by the sensor.

2. Method according to claim 1, which comprises rotating the spool again before supplying the thread suction nozzle with suction again if the thread has not been sucked into the thread suction nozzle.

3. Method according to claim 2, which comprises, during the steps of rotating the spool again and supplying suction again: rotating the spool for a limited time in the forward direction, subsequently bringing the spool to a standstill, subsequently supplying the suction nozzle with suction for a limited time while the spool is rotated again in the reverse direction, subsequently moving the suction nozzle back to the starting position independent of the presence of the thread end in the suction nozzle, initiating the delivery of the thread to the thread connector if the thread has been sucked into the thread suction nozzle, and issuing an inhibit signal if the thread has not been sucked into the thread suction nozzle.

4. Device for locating and holding an end of a thread, comprising a winding station including a spool on which the thread is wound, and a driving device connectible to said spool for switching said spool into forward, reverse and standstill operation; a thread connector for partially unwinding the thread, including a thread joining device, a thread suction nozzle movable into vicinity of the surface of said spool for sucking-in the thread and movable to said thread joining device for inserting the sucked-in thread into said thread joining device, a switchable suction supply device connected to said thread suction nozzle for applying suction to the thread through said thread suction nozzle, an air suction metering device of said suction supply device, and a sensor connected to said thread suction nozzle for sensing presence of the thread; at least one control element; and switchable operative connections connected between said control element and said winding station and between said control element and said thread connector, said control element causing suction to be reapplied to the thread through said thread suction nozzle before moving said thread suction nozzle to said thread joining device if the thread is not sensed by said sensor.

5. Device according to claim 4, including means for sequentially: starting said thread connector with said winding station, moving said thread suction nozzle to vicinity of said spool for sucking-in the thread, simultaneously switching said driving device to said standstill operation, switching on said suction supply device in dependence on said driving device being switched into said standstill operation, switching said driving device into said reverse operation, moving said nozzle to a starting position thereby inserting the sucked-in thread into said thread joining device, switching said driving device to said standstill operation, activating said thread joining device, and subsequently switching on said winding station again.

6. Device according to claim 4, wherein said control element includes a repeater for repeating suction with said suction nozzle before said suction nozzle is moved to said thread joining device.

7. Device according to claim 6, including means for activating said repeater only if sucking in the thread with said suction nozzle was not successful.

8. Device according to claim 4, including a device connected to said control element for measuring rotation and standstill of said spool.

9. Device according to claim 8, wherein said measuring device is connected to said driving device for switching said spool into reverse rotation.

10. Device according to claim 8, wherein said measuring device is connected to said spool.

11. Device according to claim 8, including a thread sensor connected to said control element for activating said measuring device by indicating absence of the thread delivered to said spool in vicinity of said winding station.

12. Device according to claim 9, including a thread sensor connected to said control element for activating said measuring device by indicating absence of the thread delivered to said spool in vicinity of said winding station.

13. Device according to claim 10, including a thread sensor connected to said control element for activating said measuring device by indicating absence of the thread delivered to said spool in vicinity of said winding station.

* * * * *